US007454871B2

(12) United States Patent
Sproules

(10) Patent No.: US 7,454,871 B2
(45) Date of Patent: Nov. 25, 2008

(54) ADJUSTABLE PIER

(76) Inventor: Joseph Sproules, 4916 Zenith St., Suite 235, Metairie, LA (US) 70001

( * ) Notice: Subject to any disclaimer, the term of this patent is extended or adjusted under 35 U.S.C. 154(b) by 628 days.

(21) Appl. No.: 10/812,489

(22) Filed: Mar. 30, 2004

(65) Prior Publication Data

US 2005/0252104 A1 Nov. 17, 2005

(51) Int. Cl.
*E02D 27/32* (2006.01)

(52) U.S. Cl. ..... 52/294; 52/118; 52/126.1; 52/298; 248/296.1; 248/679

(58) Field of Classification Search ..... 52/292, 52/296, 297, 298, 299, 126.1, 126.6, DIG. 11, 52/119, 118, 263, 250, 167.6, 167.7, 115, 52/293.2, 294, 295, 126.5; 405/230, 231, 405/256; 248/224.41, 224.61, 295.11, 296.1, 248/297.21, 354.1, 354.2, 357, 679, 224.51
See application file for complete search history.

(56) References Cited

U.S. PATENT DOCUMENTS

| | | | | |
|---|---|---|---|---|
| 1,570,226 | A * | 1/1926 | Basco | 254/104 |
| 2,199,605 | A * | 5/1940 | Baker | 248/354.1 |
| 3,033,509 | A * | 5/1962 | Carlson | 269/79 |
| 4,083,191 | A | 4/1978 | Donnelly | |
| 4,107,889 | A | 8/1978 | Gonsalves et al. | |
| 4,569,169 | A * | 2/1986 | Madray | 52/126.1 |
| 4,754,588 | A | 7/1988 | Gregory | |
| 4,793,110 | A | 12/1988 | Tucker | |
| 4,838,737 | A | 6/1989 | Quimby | |
| 4,918,891 | A | 4/1990 | Gerszewski | |
| 4,925,345 | A | 5/1990 | McCown, Jr. et al. | |
| 4,995,204 | A | 2/1991 | Kelso | |
| 4,997,314 | A | 3/1991 | Hartman | |
| 5,205,097 | A | 4/1993 | Harvey | |
| 5,234,287 | A | 8/1993 | Rippe, Jr. | |
| 5,515,655 | A | 5/1996 | Hoffmann | |
| 5,516,237 | A * | 5/1996 | Hebant | 405/233 |
| 5,561,950 | A | 10/1996 | Collins et al. | |
| 5,575,593 | A | 11/1996 | Raaf | |
| 5,711,504 | A | 1/1998 | Cusimano | |
| 5,800,094 | A | 9/1998 | Jones | |
| 6,038,823 | A | 3/2000 | Gallimore et al. | |
| 6,074,133 | A | 6/2000 | Kelsey | |
| 6,098,357 | A | 8/2000 | Franklin et al. | |
| 6,324,795 | B1 * | 12/2001 | Stiles et al. | 52/167.4 |
| 6,367,214 | B1 | 4/2002 | Monachino | |
| 6,371,698 | B1 | 4/2002 | Beck, III et al. | |
| 6,484,469 | B2 * | 11/2002 | Drake | 52/649.2 |
| 6,494,005 | B2 * | 12/2002 | Zimmerman | 52/296 |
| 6,748,717 | B2 * | 6/2004 | Sumner, Sr. | 52/745.12 |

* cited by examiner

*Primary Examiner*—Richard E. Chilcot, Jr.
*Assistant Examiner*—William V Gilbert
(74) *Attorney, Agent, or Firm*—Hovey Williams LLP

(57) ABSTRACT

An adjustable pier system that allows the elevation of a building structure to be readily adjusted when soil subsidence occurs. The adjustable pier includes telescopically intercoupled upper and lower members. The lower member is coupled to a grade beam or spread footing, while the upper member is coupled to a sill beam of the structure. When the elevation of the structure is adjusted upwardly, the adjustable pier is automatically extended. After extension, a mechanical stop can be inserted between the upper and lower members to prevent retraction of the adjustable pier.

17 Claims, 4 Drawing Sheets

ADJUSTABLE PIER

BACKGROUND

1. Field of the Invention

The present invention relates generally to systems for supporting building structures on a relatively unstable base. In particular, the present invention relates to an adjustable pier system for supporting a residential home on unstable soil.

2. Brief Description of the Prior Art

Unstable soil poses many challenges in the construction and maintenance of building structures, such as residential homes. In particular, structures built in areas of unstable soil frequently experience foundation and wall cracking due to soil subsidence. It is well know that available methods for repairing/replacing cracked foundations and walls are very expensive.

In certain relatively flat regions prone to flooding (e.g., the Mississippi River Delta), many homes and other building structures are built on piers. These piers (typically formed of brick or cinder blocks) are used to raise the elevation of the structure above certain flood levels, without having to re-grade the entire lot. Buildings constructed on piers generally employ sill beams, which rest on the top of the piers and support the load-bearing walls and floor trusses of the structure.

Some conventional pier-supported buildings are constructed with the piers sitting directly on the soil. In such a case, each pier is highly prone to elevational and/or lateral shifting over time. Other conventional pier-supported buildings are constructed with the piers supported on spread footings. Spread footings are typically formed of a square pad (e.g., 4'×4'×10") of reinforce concrete. Spread footings help temper settling of the piers by spreading the vertical load over a larger area of the soil. However, each of these spread footings is still prone to shifting as the soil subsides.

In areas known for highly unstable soil (e.g., the Mississippi River Delta) many homes and other building structures are supported by a pier on grade beam system. In such a system, relatively large reinforced concrete grade beams are placed in the ground under each exterior and interior supporting wall of the home. The individual grade beams are physically connected with one another to form a unitary base for supporting the home on the unstable soil. The piers are placed on the grade beams and used to support the main structure of the home on the grade beam. However, even when grade beams are employed, soil subsidence can cause the grade beams to tilt and/or crack over time. When this happens, expensive measures must be taken to repair and/or re-level the home. Typically, the home is leveled by adjusting the elevation of the grade beams and/or by adjusting the height of the piers. Using conventional methods, both these operations are very expensive and dangerous.

OBJECTS AND SUMMARY OF THE INVENTION

It is, therefore, an object of the present invention to provide a building support system which can be easily adjusted to thereby prevent excessive tilting and/or cracking of the building caused by soil subsidence. Another object of the invention is to provide a building support system which can be readily installed in existing homes and used to prevent further tilting and/or cracking caused by soil subsidence. Still another object of the invention is to provide a more cost effective system for leveling a building structure. Yet another object of the invention is to provide a safer system for leveling a building structure. It should be understood that the above-listed objects are only are only exemplary, and the present invention need not accomplish all of the objects listed above.

Accordingly, one aspect of the present invention concerns an adjustable pier for supporting a structure on a base. The adjustable pier comprises a lower support member and an upper support member. The lower support members defines an internal chamber. The upper support member is at least partly received in the internal chamber and extends upwardly from the lower support member. The upper support is upwardly shiftable relative to the lower support member. The lower support member defines an opening for providing lateral access to the internal chamber from outside the lower support member.

Another aspect of the present invention concerns an adjustable support system for supporting a building structure on relatively unstable soil. The adjustable support system comprises a base member, an adjustable pier, and a bearing device. The adjustable pier is supported on the grade beam and includes a lower support member coupled to the base member and an upper support member telescopically intercoupled with the lower support member. The bearing device includes a lower section rigidly coupled to the upper support member and an upper section rigidly coupled to the building structure. The upper and lower sections of the bearing device are hingedly intercoupled.

A further aspect of the present invention concerns a method of leveling a building structure supported on a base by an adjustable pier. The adjustable pier includes telescopically intercoupled upper and lower support members. The method comprises the steps of: (a) raising at least a portion of the building structure relative to the base to thereby cause extension of the adjustable pier; and (b) inserting a stop member between the upper and lower support members and below the bottom of the upper support member to thereby inhibit retraction of the adjustable pier.

BRIEF DESCRIPTION OF THE DRAWING FIGURES

Preferred embodiments of the invention are described in detail below with reference to the following drawing figures, wherein.

DETAILED DESCRIPTION OF THE PREFERRED EMBODIMENTS

Figure 1:
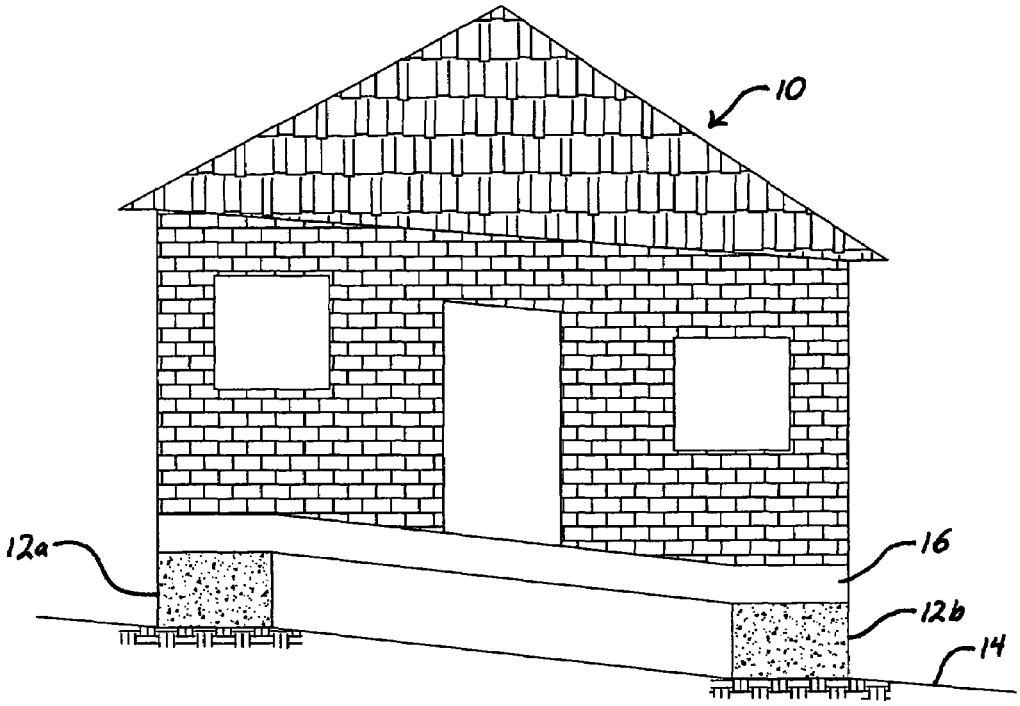
FIG. 1 is a side view of a building structure that has tilted due to soil subsidence.

Referring initially to FIG. 1, a conventional pier-supported building structure 10 is illustrated. The structure 10 is supported by conventional piers 12*a,b* which rest on the soil surface 14. The building structure 10 includes sill beams 16 which sit on top of the piers 12 and support the walls and floors of the structure 10 between the piers 12. As illustrated in FIG. 1, soil subsidence may cause one pier 12*b* to shift downwardly relative to another pier 12*a*. This relative vertical shifting of the piers 12*a,b* can cause many problems in the building structure 10 such as, for example, wall cracking and improperly fitting doors and windows.

Figure 2:
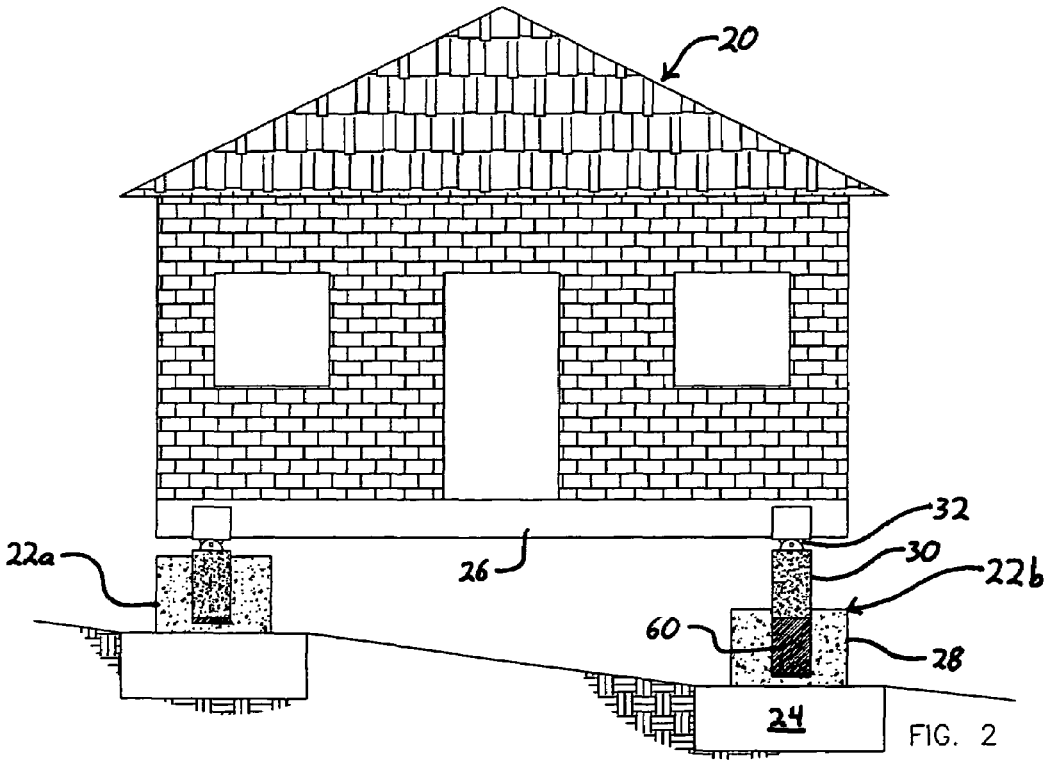
FIG. 2 is a side view of a building structure that has been leveled by extending one or more adjustable piers.

Referring now to FIG. 2, a building structure 20, preferably a residential home, is illustrated as being supported by a system of adjustable piers 22*a,b*. The adjustable piers 22*a,b* extend between a base member 24 and a sill beam 26 of the building structure 20. The base member 24 is preferably a grade beam or a spread footing, most preferably a grade beam. The adjustable piers 22*a,b* generally comprise a lower support member 28, an upper support member 30, and a bearing device 32. It is preferred for the lower and upper support members 28,30 to be formed primarily of concrete, while the bearing device is formed primarily of metal.

Figure 3:
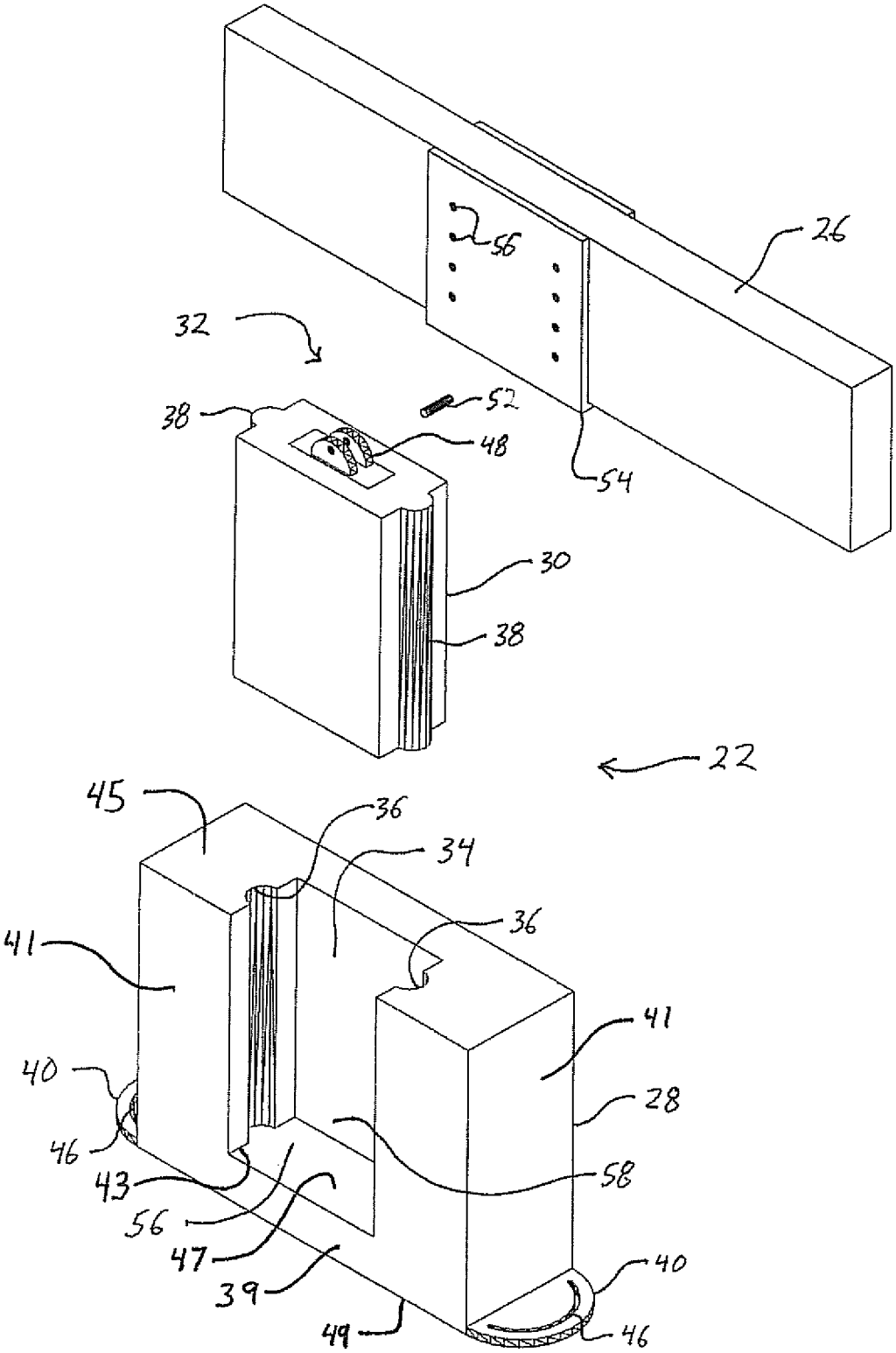
FIG. 3 is an isometric assembly view of the individual components of the adjustable pier, as well as the sill beam of a structure supported by the pier.
Figure 4:
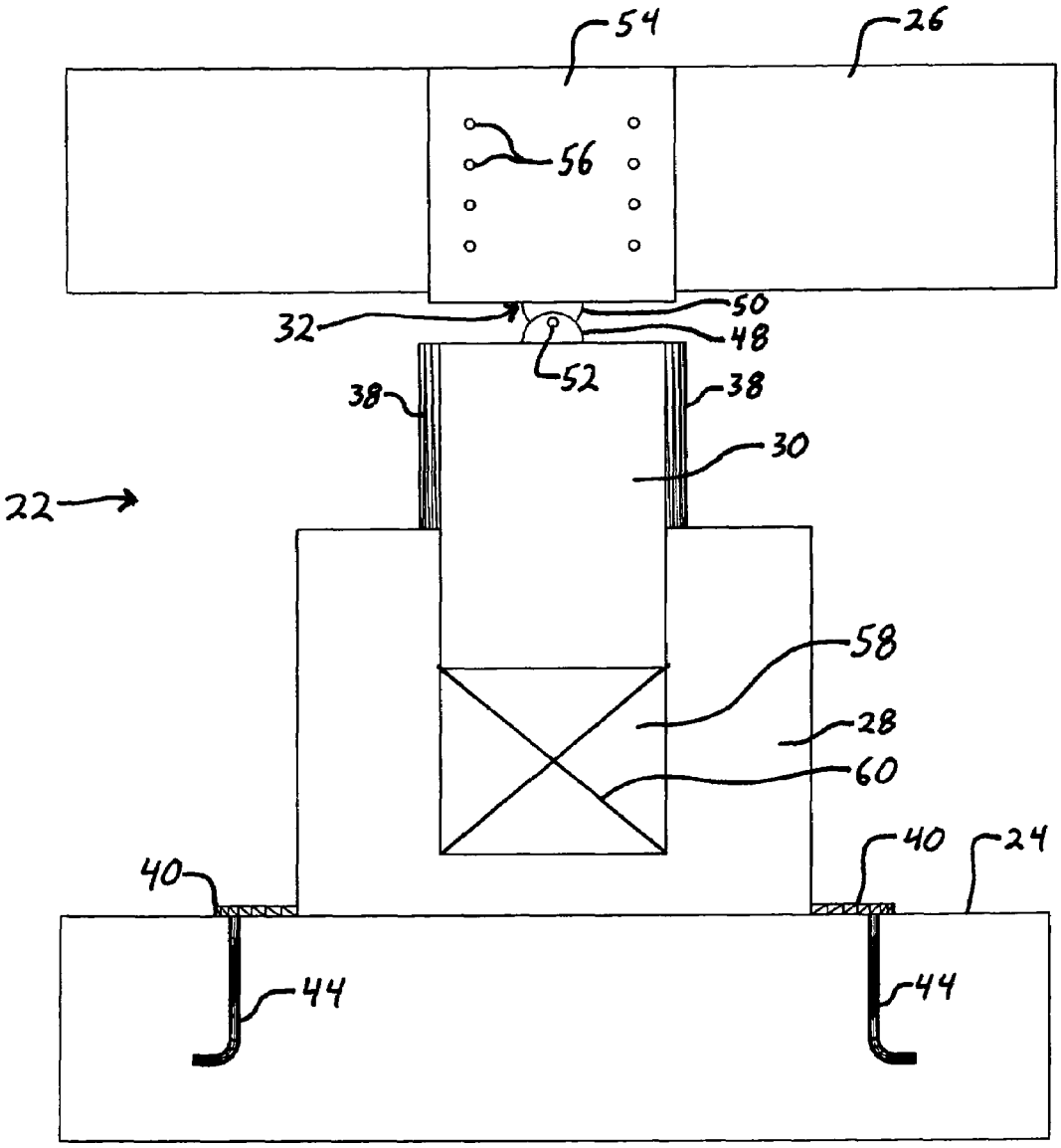
FIG. 4 is an enlarged side view of the adjustable pier having its lower section coupled to a grade beam or spread footing and its upper section coupled to a sill beam.

FIGS. 3 and 4 illustrate the individual components of the adjustable pier 22 in more detail. The lower support member 28 includes a base 39 and a vertically extending sidewall 41. Sidewall 41 has a first end 43 and a second end 45, with first end 43 being spaced beneath second end 45. Base 39 has an upper surface 47 and a lower surface 49. Base 39 and sidewall 41 define an internal chamber 34 which receives at least a portion of the upper support member 30. Upper surface 47 of base 39 is exposed to internal chamber 34, and first end 43 of sidewall 41 terminates at upper surface 47. The lower support member 28 defines a pair of upwardly extending grooves 36 in opposite, inwardly facing surfaces adjacent the internal chamber 34. The upper support member 30 presents a pair of projections 38 on opposite, outwardly facing sides of the upper support member 30. It is preferred for the upwardly extending grooves 36 in lower support member 28 to extend linearly a distance of at least 6", more preferably at least 12", while the projections 38 in upper support member 30 extend linearly a distance of at least 3", more preferably at least 6". When the upper support member 30 is received in the internal chamber 34 of the lower support member 28, the projections 38 are slidably received in the grooves 36 to thereby permit upward translational shifting of the upper support member 30 relative to the lower member 28, while restraining relative non-translational shilling (i.e., tilting or rotating) of the lower and upper support members 28,30. Thus, the lower and upper support members 28,30 are telescopically intercoupled. As used herein, "telescopically intercoupled" denotes the coupling of two members where (1) one member is at least partly received in the other member, (2) the members can translate/slide axially relative to one another, (3) relative axial rotation of the members is not required to cause relative axial shilling of the members, and (4) relative axial rotation of the members is substantially inhibited. It is preferred for the telescopic intercoupling of the lower and upper support members 28,30 to be accomplished without threadably intercoupling the lower and upper support members 28,30. Further, it is preferred for lower and upper support members 28,30 to be axially shiftable relative to one another without requiring a screwing/unscrewing action of any member that is physically coupled to or integrated with the adjustable pier 22. It is preferred for lower and upper support members 28,30 to be formed primarily of concrete.

Referring to FIGS. 3 and 4, the lower support member 28 can include a pair of aligning flanges 40 for fixedly coupling the lower support member 28 to the base member 24. It is preferred for the aligning flanges 40 to be formed of a metallic material. When the lower support member 28 is formed primarily of concrete, it is preferred for a portion of the metallic aligning flanges 40 to be embedded in the concrete to thereby permanently affix the metallic flanges 40 to the concrete portion of the lower support member 28. As shown in FIG. 4, one way to rigidly couple the aligning flanges 40 to the base member 24 is to equip the base member 24 with properly placed J-bolts 44 during fabrication of the base member 24. Alternatively, the aligning flanges 40 can be coupled to base member 24 via any conventional means such as, for example, drilling a hole in the base member 24 and anchoring or grouting a bolt therein. As shown in FIG. 3, each aligning flange 40 defines an arcuate aligning slot 46 that permits the lower support member 28 to be rotated relative to the base member 24 prior to coupling the flange 40 to the base member 24 via the J-bolt 44 or other coupling means.

FIGS. 3 and 4 illustrate that the bearing device 32 of the adjustable pier 22 is used to couple the upper support member 30 to the sill beam 26. The bearing device 32 generally includes a lower hinge member 48, an upper hinge member 50, a hinge pin 52, and a U-shaped sill flange 54. It is preferred for all of the components of the bearing device 32 to be comprised primarily of a metallic material. The lower hinge member 48 is rigidly coupled to the top of the upper support member 30 by any means known in the art. When the upper support member 30 is formed primarily of concrete, it is preferred for a portion of the lower hinge member 48 to be embedded in the concrete to thereby permanently affix the lower hinge member 48 to the concrete portion of the upper support member 30. Further, it is preferred for the upper hinge member 50 and the sill flange 54 to be permanently affixed to one another via welding or other suitable means. The sill flange 54 is preferably formed in a generally U-shaped configuration so as to receive the sill beam 26 therein. Once the sill beam 26 is received in the sill flange 54, the sill flange 54 can be coupled to the sill beam 26 via any conventional fastening means such as, for example, bolts, screws, or nails 56. The lower hinge member 48 and the upper hinge member 50 are hingedly intercoupled via the hinge pin 52. Preferably, the lower hinge member 48 includes two spaced-apart elements having aligned holes formed therein for receiving the hinge pin 52. Preferably, the upper hinge member 50 includes a single element having a hole formed therein for receiving the hinge pin 52. The pivot joint of the bearing device 32 is formed by placing the single element of the upper hinge member 50 between the two elements of the lower hinge member 48, aligning the holes of the lower and upper hinge members 48,50, and inserting the hinge pin 52 into the aligned holes of the lower and upper hinge members 48,50. In an alternative embodiment, the upper hinge member 50 can comprise two spaced-apart elements and the lower hinge member 48 can comprise the single element received between the pair of elements of the upper hinge member 50.

The hinge joint formed in the bearing device 32 permits pivoting of the sill beam 26 and the adjustable pier 22 relative to one another. Such pivoting is important when the sill beam 26 is adjusted from a skewed orientation to a substantially horizontal orientation. Without the hinge joint in the bearing device 32, undesirable stresses would be placed on the sill beam 26, the bearing device 32, and/or the adjustable pier 22. Further, the bearing device 32 couples the upper support member 30 to the sill beam 26 in a manner such that upward shifting of the sill beam 26 via an externally applied force causes automatic extension of the adjustable pier 22 by shifting/pulling the upper support member 30 upward relative to the lower support member 28.

Referring again to FIGS. 3 and 4, it is preferred for the lower support member 28 to define a lateral access opening 56 which permits lateral access to at least a lower portion 58 of the internal channel 34. As used herein, the term "lateral access" shall mean physical access to a certain region from the side of that region, as opposed to access from the top or bottom of the region. Lateral access opening 56 is located between first end 43 and second end 45 of sidewall 41. In one embodiment, the height of access opening 56 is equal to the distance between first end 43 and second end 45 of sidewall 41. Lateral access to the internal chamber 34 is important because such lateral access is needed for inserting a mechanical stop mechanism 60 (shown in FIGS. 1 and 4) into the internal chamber 34 below the bottom of the upper support member 30. The stop mechanism 60 is disposed between and directly contacts the lower and upper support members 28,30. Thus, when the stop mechanism 60 is properly inserted in the internal chamber 34, downward shifting of the upper support member 30 relative to the lower support member 28 is prevented. If extension of the adjustable pier 22 is desired, a taller stop mechanism 60 can be employed. If retraction of adjustable pier 22 is desired, a shorter stop mechanism 60 can be employed.

In a preferred embodiment of the present invention, a curable grout is employed as the stop mechanism 60. Thus, when the adjustable pier 22 is extended to its preferred height, the curable grout is inserted into and substantially fills the lower portion 58 of the internal chamber 34 located below the bottom of the upper support member 30. After the grout cures, the rigid grout transfers the vertical load from the upper support member 30 to the lower support member 28 and prevents downward shifting of the upper support member 30 relative to the lower support member 28.

In order to provide easy lateral access to the internal chamber (especially when a curable grout is employed as the stop mechanism 60), it is preferred for the width of the access opening 56 to be at least 50% of the maximum width of the upper support member 30, more preferably at least 75% of the maximum width of the upper support member 30. Preferably, the access opening 56 is at least 2" wide, more preferably at least 6" wide, and most preferably 8"-24" wide. Further, in order to provide easy access to the internal chamber 34 and to permit a sufficient range of extension of the adjustable pier 22, it is preferred for the height of the access opening 56 to be at least 50% of the maximum height of the upper support member 30, more preferably at least 75% of the maximum height of the upper support member 30. Preferably, the access opening 56 is at least 6" high, more preferably at least 12" high, and most preferably 18"-96" high. In an alternative embodiment, a plurality of smaller, vertically-spaced access openings can be employed to provide lateral access to the internal channel 34. In another embodiment, the stop mechanism 60 is a permanently rigid structure/member (as opposed to a curable grout which transforms from a slurry phase to a rigid phase during curing) that can be readily inserted into and removed from the internal channel 34 in its rigid form. Examples of such a permanently rigid structure include a block of wood, a cinder block, and a piece of metal.

Referring to FIGS. 1-4, the adjustable pier 22 can be use to retrofit an existing pier-supported building 10 (FIG. 1) or can be used for a newly constructed building 20 (FIG. 2). A building structure 20 equipped with adjustable piers 22 can be periodically re-leveled to account for shifting/tilting due to soil subsidence. Referring to FIGS. 2 and 4, in order to re-level the building structure 20, an upward force is applied to the sill beam 26 at a location spaced from the adjustable piers 22. The upward force should be of a magnitude sufficient to raise the sill beam 26 and the building structure 20. Such upward force can be provided by a hydraulic jack or other conventional jack-type mechanism. It is important to note that each adjustable pier is not equipped with its own jack because such a configuration may be prohibitively expensive. When the external upward force causes the building structure 20 to shift upwardly, the adjustable pier 22 is automatically extended in a telescopic manner. This automatic extension occurs because the lower support member 28 is coupled to the base member 24, the upper support member 30 is coupled to the sill beam 26, and upward shifting of the upper support member 30 relative to the lower support member 30 is inhibited only by gravity. Once structure 20 has been properly leveled, the mechanical stop 60 can be inserted through the lateral access opening 56 in the lower support member 28 and placed in the internal chamber 34 below the upper support member 30. This mechanical stop 60 prevents downward shifting of the upper support member 30 relative to the lower support member 28. As discussed above, the mechanical stop 60 can be any member having sufficient strength to support the vertical load exerted on the adjustable pier 22. Preferably, the mechanical stop 60 is a curable grout that substantially fills the lower portion 58 of the internal chamber 34 below the upper support member 30. When a curable grout is used as the mechanical stop 60, separate supporting means should be used to support the building structure 20 during the time period required for the grout to cure/solidify. When a jack, or several jacks, are used to level the structure, the jack(s) can be left in place until the grout is sufficiently cured. After curing, the external supporting means (e.g., jacks) can be removed so that the structure 20 is supported by the adjusted piers 22. One advantage of the adjustable pier 22 described herein is its ability to be reused. Thus, if the building structure 20 is subsequently destroyed, the adjustable pier 22 can be salvaged by simply detaching the lower support member 28 from the base member 24, detaching the bearing device 32 from the sill beam 26, and removing the stop mechanism 60 from the internal channel 34.

Figure 5:
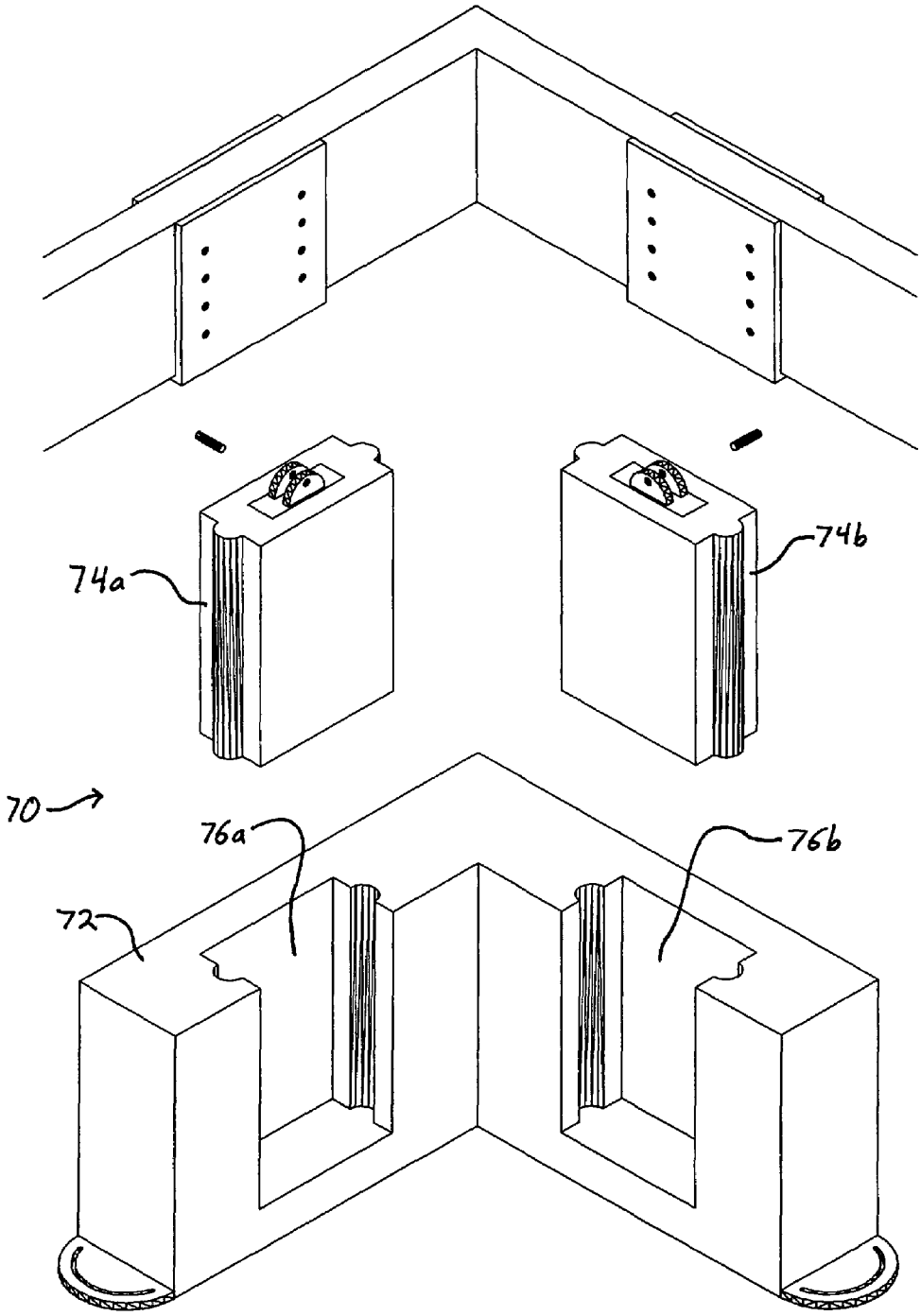
FIG. 5 in an isometric assembly view of an L-shaped adjustable corner pier system suitable for use at the corners of a building structure.

Referring now to FIG. 5, an adjustable corner pier 70 is illustrated. The adjustable corner pier 70 is a dual pier system configured to be placed at the corner of a building structure. The adjustable corner pier 70 comprises a generally L-shaped lower support member 72 and a pair of upper support members 74*a,b* adapted to be received in a corresponding pair internal chambers 76*a,b* defined by the lower support member 72. The configuration and operation of the adjustable corner pier 70 is substantially the same as described above with reference to FIGS. 1-4.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventor hereby states his intent to rely on the Doctrine of Equivalents to determine and assess the reasonably fair scope of the present invention as it pertains to any apparatus not materially departing from but outside the literal scope of the invention as set forth in the following claims.

What is claimed is:

1. An adjustable pier for supporting a structure on a base, said pier comprising:

a lower support member comprising a base and a vertically extending sidewall attached to said base, said base and said sidewall defining an internal chamber, said sidewall having a first end and a second end, said first end being vertically spaced beneath said second end, said base having an upper surface and a lower surface, said upper surface of said base being exposed to said internal chamber and said first end of said sidewall terminates at said upper surface of said base, said lower support member having a lateral access opening, said lateral access opening having a height said lateral access opening being located between said first end and said second end of said sidewall and said height is equal to the distance between said first end and said second end of said sidewall;

an upper support member at least partly received in the internal chamber, said upper support member being upwardly shiftable relative to the lower support member, said sidewall of the lower support member defining a pair of vertically extending grooves, said upper support member presenting a pair of projections at least partly received in the grooves so that relative lateral shifting and relative rotation of the upper and lower support members is inhibited, said internal chamber being configured to receive the upper support member; and a stop member received in said internal chamber between said base and said upper support member, said stop member further being a rigid member that is to be inserted into said internal chamber in its rigid form wherein said lower support member and said upper support member being formed primarily of concrete.

2. The adjustable pier of claim 1, said upper and lower support members being telescopically intercoupled.

3. The adjustable pier of claim 1, said height of said lateral access opening being at least 6 inches.

4. The adjustable pier of claim l, said stop member being a permanently rigid structure.

5. The adjustable pier of claim 1, said stop member comprising a cured grout.

6. The adjustable pier of claim 5, said cured grout filling substantially all of the internal chamber located below the upper support member.

7. The adjustable pier of claim 1, said grooves extending substantially linearly for at least 6 inches, said projections extending substantially linearly for at least 3 inches.

8. The adjustable pier of claim 1; and a metallic bearing device coupling the upper support member to the structure.

9. The adjustable pier of claim 8, said metallic bearing device including a lower section and an upper section, said lower section being rigidly coupled to the upper support member, said upper section being rigidly coupled to the structure, said upper and lower sections being hingedly intercoupled.

10. The adjustable pier of claim 1, said lower support member presenting a pair of inwardly and oppositely facing inner surfaces, each of said inner surfaces defining at least a portion of the internal chamber, each of said inner surfaces including said vertically extending grooves.

11. The adjustable pier of claim 10, said upper support member presenting a pair of outwardly and oppositely facing outer surfaces, each of said outer surfaces including one of said projections.

12. The adjustable pier of claim 1, said structure being a residential home, said base being a spread footing or a grade beam.

13. An adjustable support system for supporting a building structure on a relatively unstable soil, said support system comprising:

a base member supported by the soil;

an adjustable pier supported on the base member, said pier including a lower support member coupled to the base member and an upper support member telescopically intercoupled with the lower support member; and a bearing device including a lower section rigidly coupled to the upper support member and an upper section rigidly coupled to the building structure, said upper and lower sections being hingedly intercoupled, said lower support member defining an internal chamber for receiving the upper support member, said lower support member defining an opening for providing lateral access to the internal chamber from outside the lower support member, said opening having a height that is at least 50% of the maximum height of the upper support member said opening having a height that is at least 6 inches, wherein said base member being formed primarily of concrete, said pier being formed primarily of concrete, and said bearing device being formed primarily of a metal said opening extending along substantially the entire height of the internal chamber.

14. The support system of claim 13, said lower support member surrounding the upper support member on at least three sides.

15. The support system of claim 13, said lower member presenting a pair of opposing inwardly facing inner surfaces, said upper support member presenting a pair of outwardly facing outer surfaces, each of said outer surfaces being disposed adjacent a respective inner surface, each pair of adjacent inner and outer surfaces having an elongate groove associated with one of the surfaces and an elongated projection associated with the other of the surfaces, with the elongated projection being received in the elongated groove.

16. The support system of claim 13; and a cured grout disposed in the internal chamber below the bottom of the upper support member, said cured grout contacting the upper and lower support members to thereby prevent downward shifting of the upper support member relative to the lower support member.

17. The support system of claim 13, said building structure being a residential home, said base member being a grade beam or a spread footing.

* * * * *